US005597154A

United States Patent [19]

Yamashita

[11] Patent Number: 5,597,154

[45] Date of Patent: Jan. 28, 1997

[54] AUTOMATIC DOCUMENT FEEDER WITH POSITION COMPENSATING DEVICE

[75] Inventor: Masashi Yamashita, Kohfu, Japan

[73] Assignee: Nisca Corporation, Yamanashi-ken, Japan

[21] Appl. No.: 524,486

[22] Filed: Sep. 7, 1995

Related U.S. Application Data

[62] Division of Ser. No. 141,972, Oct. 28, 1993, Pat. No. 5,484,141.

[30] Foreign Application Priority Data

Oct. 29, 1992 [JP] Japan ..... 4-313953

[51] Int. Cl.[6] ..... B65H 5/00

[52] U.S. Cl. ..... 271/10.05; 271/10.03; 271/10.12; 271/110; 271/242

[58] Field of Search ..... 271/10.03, 10.05, 271/10.11, 10.12, 110, 227, 242, 265.01, 3.17, 4.01

[56] References Cited

U.S. PATENT DOCUMENTS

| | | | |
|---|---|---|---|
| 5,090,675 | 2/1992 | Nagai et al. | 271/10.12 |
| 5,112,038 | 5/1992 | Dunaway | 271/10.03 |
| 5,192,067 | 3/1993 | Saito | 271/10.03 |
| 5,415,387 | 5/1995 | Suzuki | 271/227 |
| 5,484,141 | 1/1996 | Yamashita | 271/227 |

FOREIGN PATENT DOCUMENTS

| | | | |
|---|---|---|---|
| 0059137 | 4/1983 | Japan | 271/110 |
| 402106532 | 4/1990 | Japan | 271/10.05 |
| 405024719 | 2/1993 | Japan | 271/3.17 |

*Primary Examiner*—H. Grant Skaggs
*Attorney, Agent, or Firm*—Kanesaka & Takeuchi

[57] ABSTRACT

An automatic document feeder is formed of a transfer device having a transfer belt situated above a platen to transfer a sheet on the platen, and a belt motor for actuating the transfer belt, a sheet detecting device situated near the transfer belt for detecting the sheet, and a feeding device located near the transfer belt at a side of the sheet detecting device. The feeding device feeds the sheet between the transfer belt and the platen. A controlling device is electrically connected to the sheet detecting device and the belt motor. The controlling device, while the belt motor for transferring the sheet on the platen is actuating, outputs a stop signal to stop the belt motor when a predetermined time has passed after the sheet detecting device detects the sheet so that the sheet is placed on a predetermined position on the platen. The feeder further includes a compensating device connected to the controlling device. The compensating device assumes an amount of overrun of the belt motor from a time that the belt motor receives the stop signal to a time that the belt motor actually stops, and compensates a time that the stop signal is outputted from the controlling device based on the overrun amount. Thus, the sheet is stopped at the predetermined position.

4 Claims, 14 Drawing Sheets

11 : DISTANCE OF TRANSFER OF SHEET

P1 : PULSE NUMBER WHEN TRANSFERRING $1_1$

12 : DISTANCE UNTIL DECISION OF SPEED

P2 : PULSE NUMBER WHEN TRANSFERRING $1_2$

13 : 11 − 12

P3 : P1 − P2

14 : SLIPPING AMOUNT WHEN TRANSFERRING $1_1$

P4 : PULSE NUMBER WHEN TRANSFERRING $1_4$

15 : OVERRUN AMOUNT OF TRANSFER MOTOR

P5 : OVERRUN PULSES

16 : MOVING DISTANCE WHILE MEASURING SPEED

P6 : PULSE NUMBER WHEN TRANSFERRING $1_2$

AUTOMATIC DOCUMENT FEEDER WITH POSITION COMPENSATING DEVICE

CROSS-REFERENCE TO RELATED APPLICATION

This is a divisional application of patent application Ser. No. 08/141,972, filed on Oct. 28, 1993, now U.S. Pat. No. 5,484,141.

BACKGROUND OF THE INVENTION AND RELATED ART STATEMENT

The present invention relates to an automatic document feeder with a position compensating device for precisely locating a sheet, document or manuscript onto a predetermined position on a platen.

A document feeder has been known, wherein a transfer belt is located to cover a platen for an image printing apparatus, such as a copy machine, and a sheet or manuscript is transferred on the platen by actuation of the transfer belt.

In this machine, it is important that the sheet is stopped precisely at a predetermined copy position. In order to precisely locate the sheet at the copy position, a document feeder as disclosed in Japanese patent publication (examined) No. 3-56615 compensates timing for generating a stop signal for the transfer belt, wherein an error until the sheet reaches the copy position is obtained based on the distance that the sheet is transferred only by the transfer belt and a memorized slipping amount for a predetermined distance between the belt and the sheet, and pulses for a motor for actuating the transfer belt are adjusted based on the pulses of the error.

However, even if the timing for stopping the transfer belt is adjusted based on the slipping amount for the predetermined distance and the transfer distance of the sheet, if the sheet can not be stopped immediately by stopping the motor for actually actuating the transfer belt at the same time of receiving the stop signal, such compensation is insufficient.

Namely, in the conventional compensating method, the compensation for an overrun amount of the motor for the transfer belt, i.e. the distance that the sheet is actually stopped as soon as the belt stop signal is outputted, is insufficient. Thus, it is impossible to sufficiently adjust the stopping position.

Also, it is difficult to keep the sheet transfer speed constant before the stopping position, since the sheet size and the sheet transfer mode are not constant. Since the sheet transfer speed is different, the overrun amount is not constant, so that it is difficult to improve stopping accuracy of the sheet.

Therefore, an object of the invention is to provide an automatic document feeder, wherein a sheet or document can be stopped at a predetermined position with a very little tolerance.

Another object of the invention is to provide an automatic document feeder as stated above, wherein a stopping position can be controlled precisely regardless the size or copy mode of the sheet.

Further objects and advantages of the invention will be apparent from the following description of the invention.

SUMMARY OF THE INVENTION

In accordance with the present invention, an automatic document feeder is formed of, as usual, a transfer device situated above a platen, a sheet detecting device situated near the transfer belt for detecting the sheet, and a feeding device located near the transfer belt at a side of the sheet detecting device. The feeding device feeds the sheet between the transfer belt and the platen.

A controlling device is electrically connected to the sheet detecting device and a belt motor of the transfer device. While the belt motor on the platen is actuating, the controlling device outputs a stop signal to stop the belt motor when a predetermined time has passed after the sheet detecting device detects the sheet, so that the sheet is placed on a predetermined position on the platen.

In the invention, a compensating device is connected to the controlling device. The compensating device assumes an amount of overrun of the belt motor from a time that the belt motor receives the stop signal to a time that the belt motor actually stops, and compensates a time that the stop signal is outputted from the controlling device based on the overrun amount. Thus, the sheet is stopped precisely at the predetermined position regardless the size and copy mode of the sheet.

DETAILED DESCRIPTION OF PREFERRED EMBODIMENTS

The automatic document feeder of the invention can be used for a copy machine, facsimile and so on, but for explanation, the feeder attached to a copy machine is explained with reference to the drawings.

Figure 1:
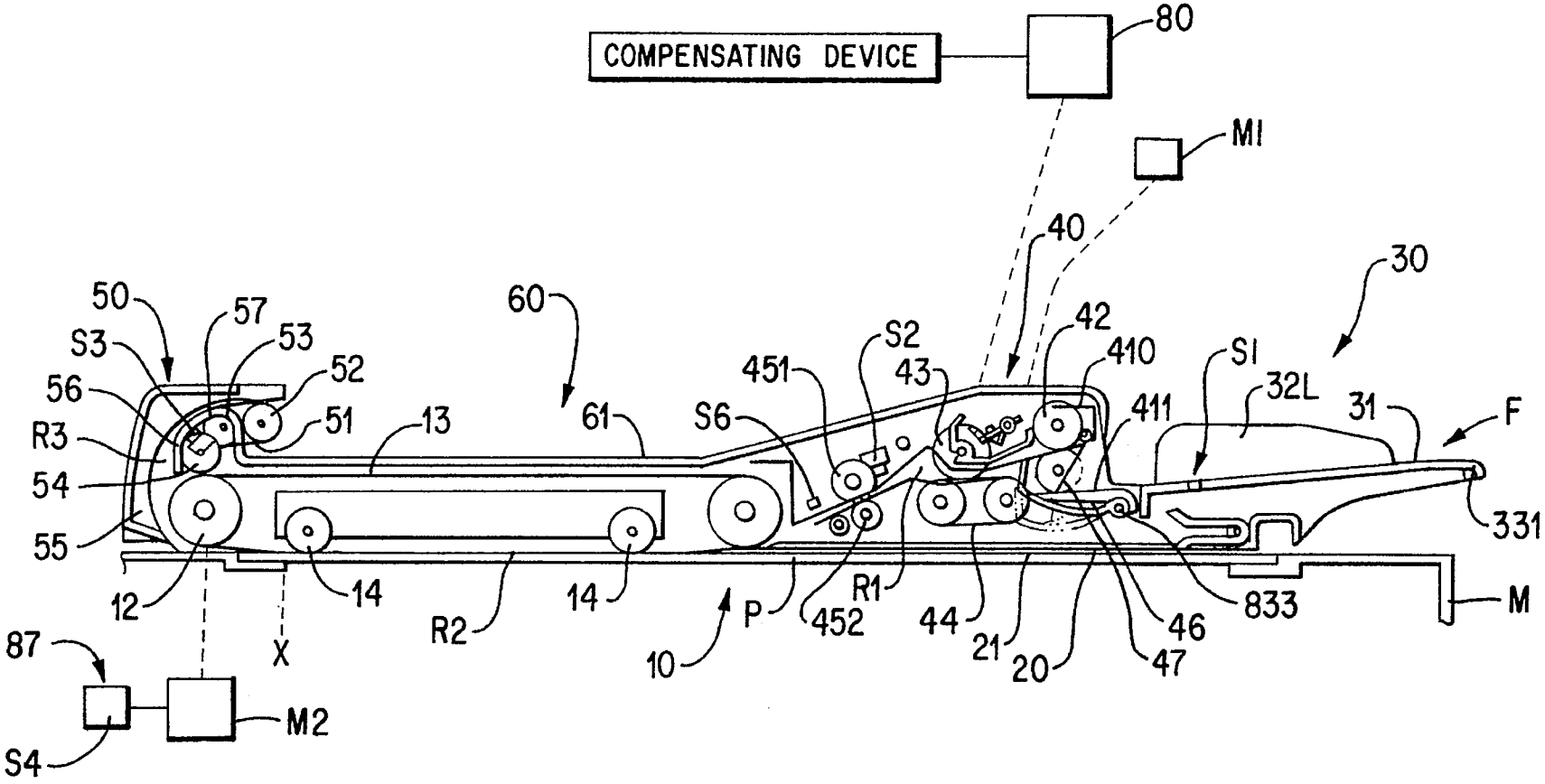
FIG. 1 is an explanatory side view of a feeder of the present invention.

Referring to FIG. 1, an automatic document feeder F is placed on a platen P of a copy machine M. The feeder F is formed of a transfer section 10 for covering nearly a half of the platen P, a platen cover section 20 for covering the rest of the platen P, a document tray section 30 located above the cover section 20, a separating and feeding section 40 situated above the cover section 20 and separating and feeding sheets or documents set on the tray section 30 toward the platen P, an ejecting section 50 which receives the sheets from the transfer section 10 and ejecting from the platen P, and a receiving section 60 for receiving the sheets ejected from the ejecting section 50. The feeder F is hinged to the copy machine M so that the feeder F can be opened and closed relative to the platen P. The feeder F also includes an actuating and controlling section 80 for properly operating the feeder F.

The document feeder F further includes motors M1, M2, and five sensors S1–S5 for controlling the operation of the feeder F. The motor M1 is connected to the separating and feeding section 40, and is basically controlled by the sensors S1 and S5. The motor M2 is connected to the transfer section 10, and is basically actuated by the sensors S2, S3, S4.

S1 is an empty sensor for sensing if a sheet is placed in the tray section 30. S2 is a register sensor located in a path from the separating and feeding section 40 to the platen P. The sensor senses a front and/or rear end of a sheet, and operates as a first detecting device. S3 is a switch back sensor for sensing a front and/or rear end of a sheet ejected to the ejecting section 50. The sensor S3 operates as a second detecting device.

S4 is a photo sensor for sensing a rotation amount of an interrupter of an output shaft of the motor M2. The sensor S4 together with the interrupter constitutes a pulse generating device 87. S5 (not shown) is a sensor for sensing that the feeder F is opened or closed relative to the platen.

The platen P has a reference line X. The front ends of all the sheets are transferred by the transfer section 10 and are aligned at the reference line X. When a small size sheet, such as A4 paper, is used, the small size sheet covers a half of the platen P, while a large size sheet, such as A3 paper, is used, the large size sheet covers the entire platen P.

Figure 2:
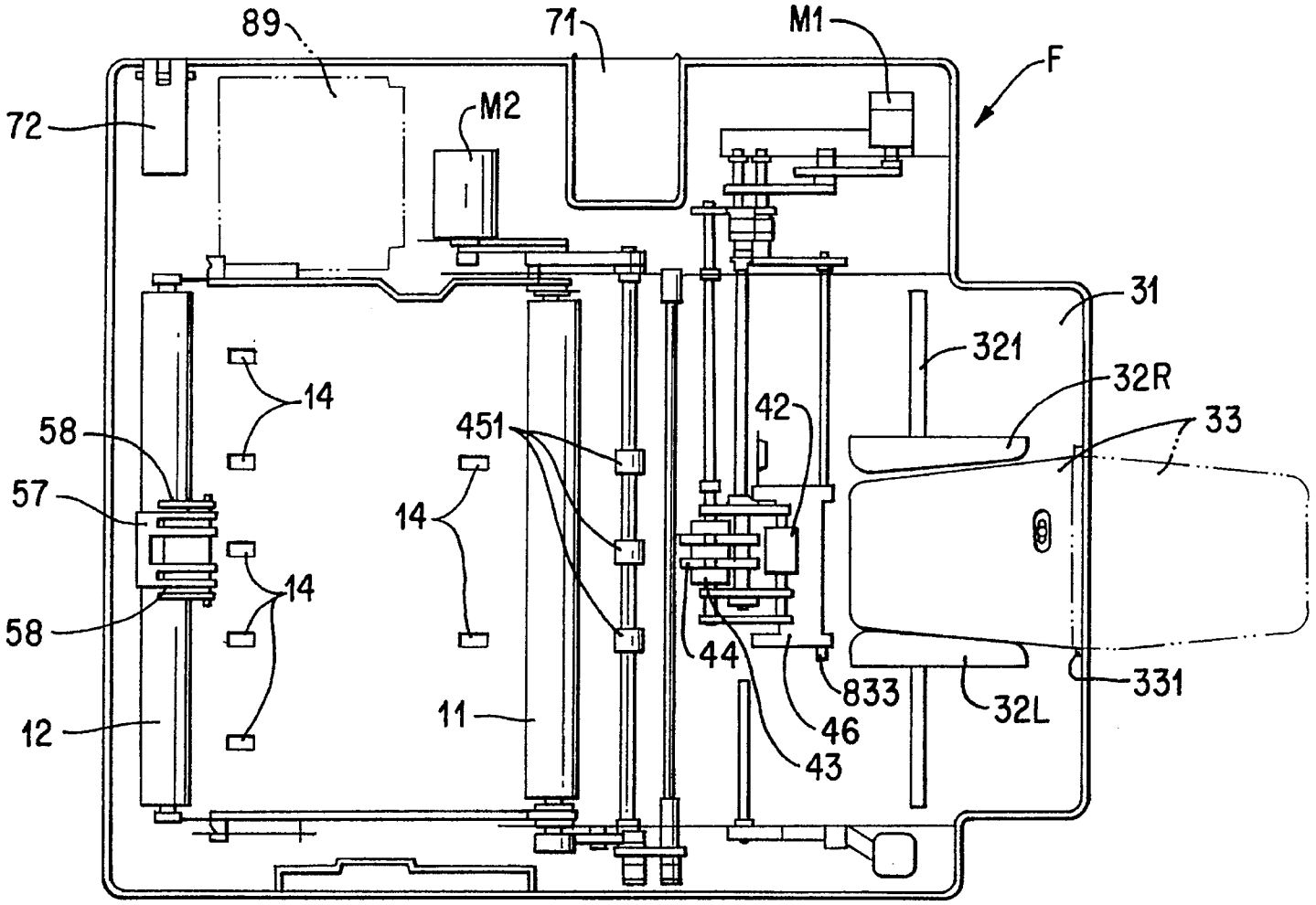
FIG. 2 is an explanatory plan view for showing an inside of the feeder as shown in FIG. 1.

As shown in FIGS. 1 and 2, the tray section 30 is formed of a tray 31 for mounting sheets to be copied, and a pair of side guides 32L, 32R for adjusting sides of the sheets, and an auxiliary tray 33. The side guides 32L, 32R can be moved in the width direction of the sheet. The auxiliary tray 33 is rotationally attached to the tray 31 by means of a shaft 331 for supporting a rear side of the large size sheet.

In the separating and feeding section 40, there is a sheet path R1 for leading a separated sheet onto the platen P. The sheet path R1 is defined by side plates (not shown). In the section 40, a pick-up roller 42 is movably situated over the tray 31, and a feeding roller 43 and a separating belt 44 are located in the sheet path R1 in the condition that the roller 43 and the belt 44 overlap but do not contact with each other. Also, at the exit of the sheet path R1, a register roller 451 and a pinch roller 452 are provided to face against each other. The exit of the sheet path R1 is located near the center of the platen P.

In the inlet of the sheet path R1, there are provided a sheet stopper 46 and a lever 47 for sensing the presence or absence of the sheet on the tray 31 which cooperate with the sensor S1. The sensor S2 is located between the feeding roller 43 and the register roller 451.

The sheet stopper 46, pick-up roller 42, feeding roller 43 and separating belt 44 are formed along the sheet path R1 and are actuated by the motor M1 through belts and gears (not shown).

When a sheet is picked up from the tray 31, the motor M1 is rotated in the forward direction, by which the stopper 46 is moved to a lower position through a shaft 833 as shown in FIG. 1, and the pick-up roller 42 is moved downwardly toward the sheet to thereby contact the sheet. Also, the rollers 42, 43 rotate in the forward direction, and the belt 44 is rotated in the reverse or rearward direction, so that the sheet on the tray 31 is moved from the inlet to the outlet of the path R1. When the motor M1 rotates in the reverse direction, the pick-up roller 42 is moved away from the sheet surface of the tray.

The transfer section 10 is formed of a transfer belt 13, a pair of rollers 11, 12 for rotating the belt 13 in forward or rearward direction, and a plurality of press rollers 14 for pushing the belt 13 onto the platen P. The belt 13 covers nearly the half of the platen P.

The belt 13 is located at the exit of the sheet path R1. A sheet path R2 is defined between the platen P and the belt 13. The inlet of the path R2 is located at about the center of the platen P, while the outlet of the path R2 is located at about the reference line X.

In the transfer section 10, the sheet ejected from the sheet path R1 is transferred to the reference line X and then ejected to the ejecting section, or the sheet is reversed.

The ejecting section 50 is formed near the outlet of the transfer section 10. The ejecting section 50 includes an endless ejecting belt 51, a pair of rollers 52, 53 for actuating the belt 51 in forward or rearward direction, a contact roller 54 for transferring rotation of the belt 13 to the roller 53, and guide members 55, 56. A sheet ejecting path R3 is defined between the guide members 55, 56 for guiding the sheet transferred from the transfer section 10 and ejecting the sheet to the receiving section 60.

A spring plate 57 is fixed to the guide member 55 near the belt 51. The spring plate 57 operates to push the sheet to the belt 51. The contact roller 54 contacts the belt 13 at a side opposite to the roller 12. The belt 51, rollers 52, 53 and the roller 54 are supported by a pair of side plates 58.

The receiving section 60 includes a tray 61, which is located above the tray 31 so that the sheets to be treated and the treated sheets slightly overlap with each other.

In FIG. 2, numerals 71, 72 are hinges to connect the feeder F to the copy machine M, and numeral 89 is a circuit board for the controlling section 80.

The transfer belt 13 is connected to the motor M2. Since the contact roller 54 contacts the belt 13, the belt 51 rotates in the same direction and speed as those of the belt 13. Also, the register roller 451 is rotated at the same direction and speed as those of the belt 13. Thus, the sheets passing through the paths R1, R2, R3 are transferred at the same and constant speed regardless the transfer direction of the sheet. The speed is controlled by clock signals of the pulse generating device 87.

A platen cover 21 can move relative to the platen P. When the belt 13 is moved in the forward direction, the platen cover 21 is kept in a close position to the platen P. When the belt 13 is rotated in the reverse direction, the cover 21 is located in the position away from the platen P.

Now, the operation of the document feeder F of the invention is explained with reference to FIGS. 3(A)–3(C).

Figure 3A:
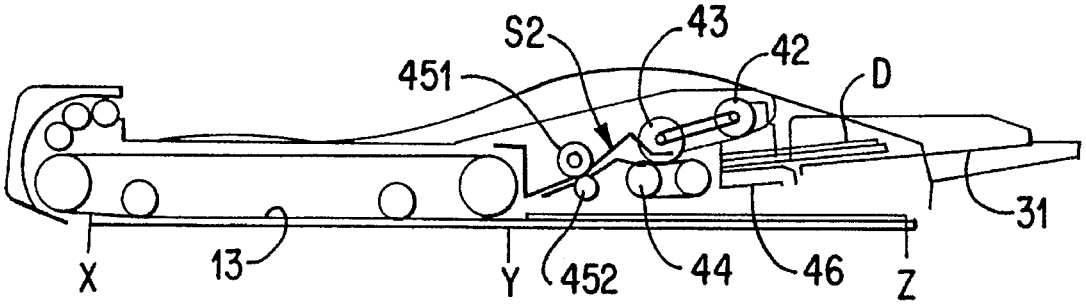
FIGS. 3(A) to 3(C) are explanatory side views for showing a transfer procedure of a short size sheet.

FIG. 3(A) shows the condition that the sheets D are placed on the tray 31. When a copy command is outputted to the copy machine M, after the empty sensor S1 confirms the presence of the sheets D, the stopper 46 is moved below the guide 411, and the pick-up roller 42 is moved downwardly onto the sheets D on the tray 31 while the pick-up roller 42 is rotating. The roller 42 contacts the sheets D. As a result, one or a few sheets is transferred forwardly, and enters between the feeding roller 43 and the separating belt 44. The sheet is moved forwardly by the roller 43 rotating in the forward or transfer direction.

Figure 3B:
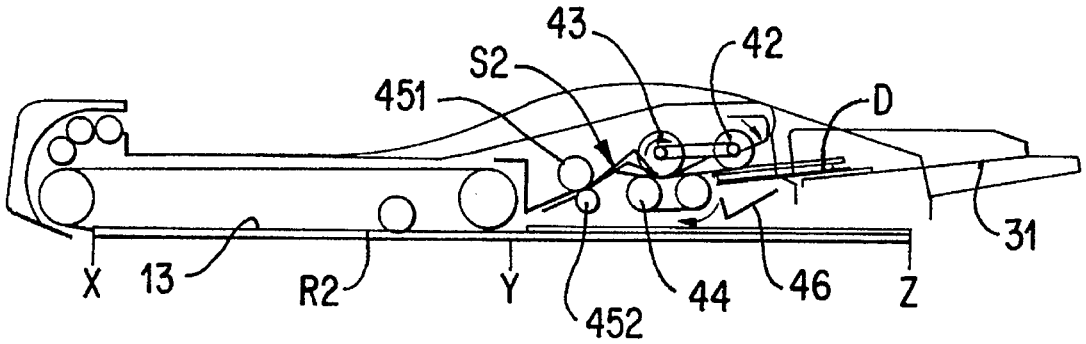
Figure 3C:
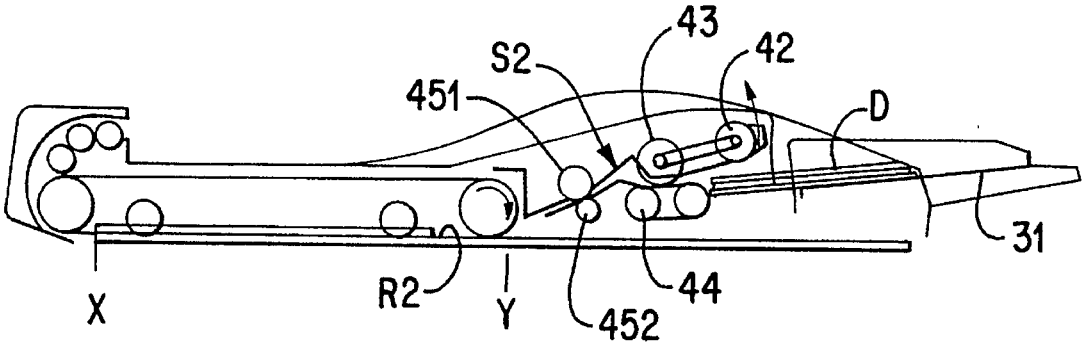

In case a plurality of sheets is located on the tray 31 and is transferred forwardly by the pick-up roller 42, as shown in FIG. 3(B), a forward movement of a lower sheet is prevented by the separating belt 44 rotating in the rearward direction. Thus, the first sheet is only transferred forwardly.

The sheet thus transferred is sensed at the front end thereof by the register sensor S2, and then abuts against the register roller 451 and the pinch roller 452 in non-operation condition. The rollers 42, 43 and the belt 44 are stopped after a predetermined time has passed since the forward end of the sheet is detected by the sensor S2. Thus, the sheet is slightly curved, and the forward end of the sheet is pushed to a contact portion of the register roller 451 and the pinch roller 452. Then, the rollers 451, 452 start to rotate. Thus, the sheet is drawn to the rollers 451, 452 while the forward end is located parallel to these rollers. Namely, skew of the sheet is corrected.

The sheet D is transferred through the path R1 and is led to the inlet of the path R2 located in the middle of the platen P. The sheet is transferred forwardly by the transfer belt 13 operated in synchronizing with the register roller 451 along the path R2. At this time, the number of pulses at the pulse generating device 87 is counted from the time that the motor M2 is started to the time that the rear end of the sheet passes through the register sensor S2. Consequently, the length of the sheet D is determined.

Namely, since the register roller 451 and the belt 13 are rotated at the same speed of the motor M2 and the pulses generated at the pulse generating device 87 and corresponding to the number of rotation of the motor M2 are counted, it is possible to recognize the number of pulses from the time that the motor M2 is started to the time that the sheet is arrived at the reference line X. Thus, when the register sensor S2 detects the rear end of the sheet while the sheet is moving from a line Y to the reference line X, it is known that the sheet which is being transferred is less than the size between X and Y. Namely, it is judged that the sheet is a small size or a large size.

In case the sheet is a small size, the transfer belt 13 is stopped after the pulse generating device 87 counts a predetermined number of pulses, i.e. A pulse, since the motor M starts to rotate. As a result, the sheet D can be stopped exactly at the reference line X, as shown in FIG. 3(C).

Figure 4:
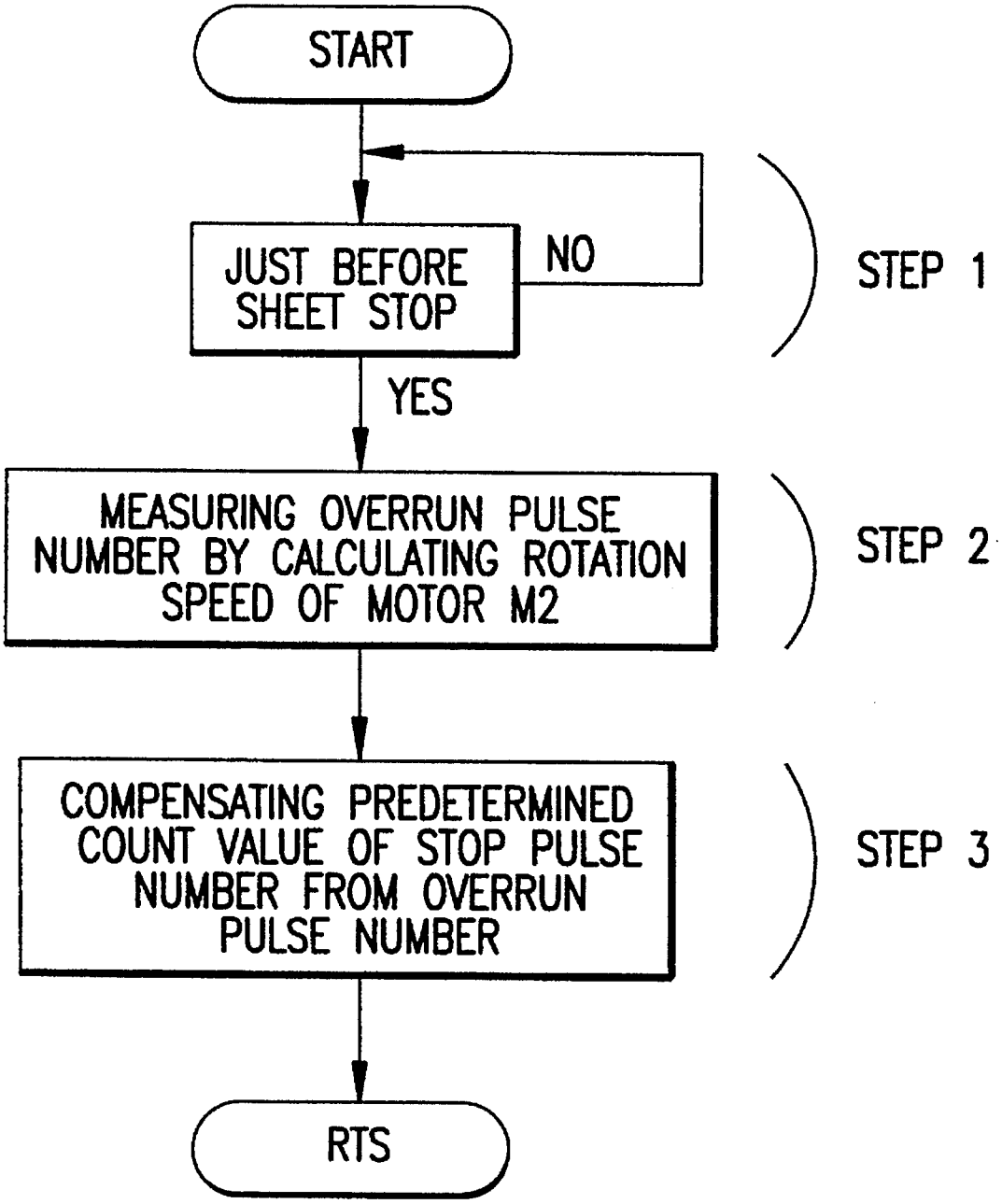
FIGS. 4 and 5 are explanatory charts for showing a first embodiment of the present invention.
Figure 5:
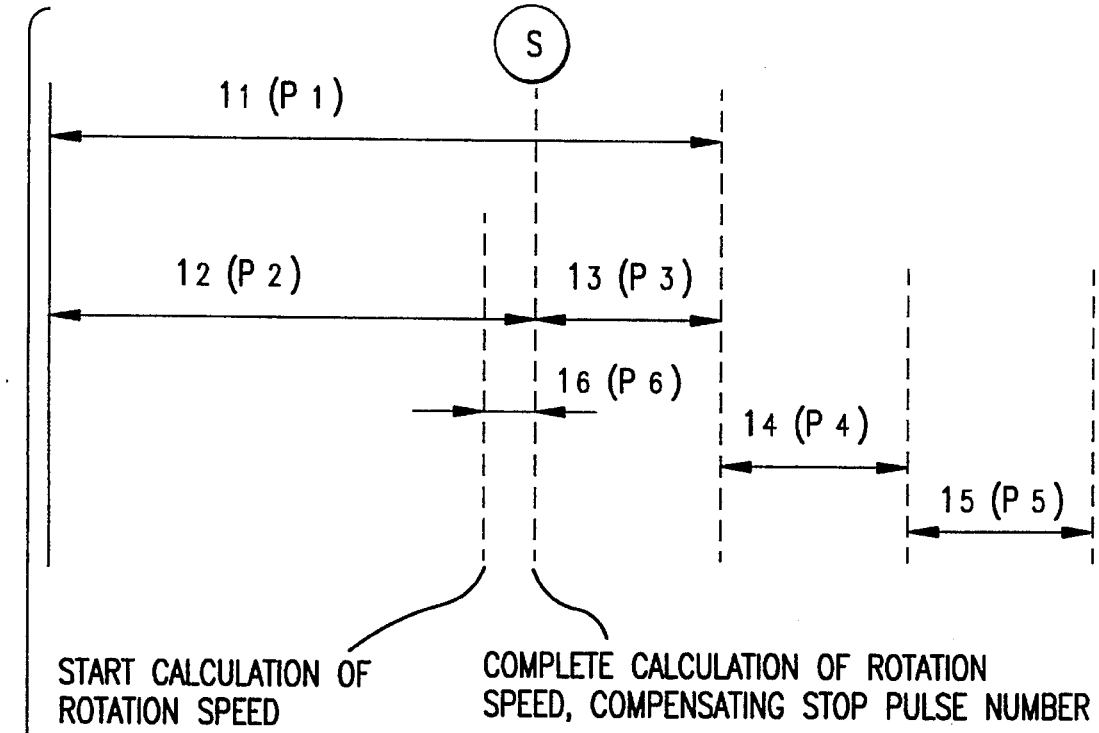

In regard to the A pulse, reference is made to FIGS. 4 and 5. For example, an amount of transfer of the belt 13 is 0.1 mm for one pulse of the interrupter of the pulse generating device 87, and a slipping amount between the sheet D and the belt 13 is 0.1 mm for 10 mm. In case the distance from the register roller 451 to the reference line X is 300 mm, the slipping amount from the register roller 451 to the reference line X and the additional pulse for correcting the slipping amount are shown in Table 1. Table 1 contains the sheet B5Y (B5 paper is disposed in lateral direction) and A4Y (A4 paper is disposed in lateral direction).

TABLE 1

| Size | Transfer Amount | Slip | No. of Pulses |
|---|---|---|---|
| B5Y | 118 mm | 1.18 mm | 12 pulses |
| A4Y | 90 mm | 0.9 mm | 9 pulses |

In view of the above, for the A4Y sheet, 909 pulses, i.e. 900 pulses which correspond to P1 in FIG. 5 plus 9 pulses which correspond to P4 in FIG. 5, are a predetermined count value for outputting the stop signal for the motor M2. The pulses are counted by a micro computer (not shown). Incidentally, even if the stop signal is outputted, the motor M2 does not stop immediately, and it causes overrun for the belt after the stop signal is outputted.

The overrun pulses corresponding to the overrun amount are different based on the condition. Assuming that 1 pulse is changed for the rotational speed of 37.5 rpm (1 pulse for the moving speed 10 mm/sec of the belt 13), in the predetermined range of the speed, the overrun pulses are show in Table 2.

TABLE 2

| Rotation Speed of M2 (rpm) | Transfer Speed (mm/sec) | Overrun Pulse No. |
|---|---|---|
| 3,000 | 800 | 35 pulses |
| 2,812.5 | 750 | 30 pulses |
| 2625 | 700 | 25 pulses |
| 2,437.5 | 650 | 20 pulses |

The contents of the above tables 1 and 2 are memorized in ROM (not shown) and are referred to in the following steps.

With reference to FIGS. 4 and 5, in case an output pulse value is calculated without considering the overrun pulse numbers, the stop pulse number Pu is:

$$Pu=P1+P4 \qquad \text{equation 1}$$

The stop pulse Pu is set at the time of detecting the sheet size, but as the front end of the sheet is arrived at the speed detecting position just before the reference line X (step 1), the rotation speed of the motor M2 is measured based on the output pulse from the pulse generating device 87 or voltage/ampere inputted to the motor M2. When the overrun pulse number is noticed at the point S based on the rotation speed of the motor as shown in FIG. 5 (step 2), the stop pulse Pu from the point S to the reference line X is:

$$Pu=P3+P4-P5 \qquad \text{equation 2}$$

Namely, the sheet stop pulse Pu is counted up to the point S, and at the point S, adjustment based on the equation 2 is added (step 3). When the counted pulse number comes to a predetermined pulse number, the stop signal for the motor M2 is outputted. As a result, it is possible to transfer and stop the sheet precisely at the reference line X. As stated above, even in a machine which can not control the speed of the sheet to be constant before the reference line or copy position due to differences of the sheet size, sheet transfer mode and so on and which has different overrun amount due to the difference of the speed, it is possible to increase accuracy of the stop position to the copy position.

Next, in case the empty sensor S1 is operated and no sheet D is detected, the copy machine M is operated to make a copy. As soon as copying is finished, the transfer belt 13 and the ejecting belt 51 are actuated to lead the sheet D to the path R3, and the sheet D is ejected to the tray 61.

In case the empty sensor S1 detects a sheet, the motor M1 is actuated to transfer the next sheet on the tray 31 to the register roller 451, and the copy machine is actuated to make a copy for the first sheet. When the copy operation is completed, the motor M2 is actuated to eject the first sheet D on the platen P, wherein the motor M2 is stopped after the pulse generating device 87 counts a predetermined number of pulses (A pulse) from the start of the motor M2. When the motor M2 is stopped, the first sheet is ejected on the tray 61 while the rear end of the first sheet is retained at the ejecting section 50.

In case the empty sensor S3 detects the sheet on the tray 31, the above operation is repeated, and the sheet copied already is transferred to the tray 61.

FIGS. 6(A) to 6(H) show a situation that a large size sheet greater than the size X–Y is handled.

After the step as shown in FIG. 3(A), the document D1 is advanced through the sheet path R2 between the belt 13 and the platen P. In case the rear end of the sheet D1 does not pass through the register sensor S2 just before the front end of the sheet passes through the reference line X, it is considered that the sheet D1 is a large size. In this case, the sheet is transferred continuously until the pulse generating device 87 counts a predetermined pulse (B pulse) after the rear end of the sheet D1 passes through the register sensor S2.

When the rear end of the sheet D1 is arrived at the entrance of the path R2 (point Y), the front end of the sheet D1 is transferred onto the tray 61 while passing through the ejecting section 50. Then, the transfer belt 13 is rotated in the reverse direction so that the sheet D1 is reversely transferred along the platen P. As a result, a part of the sheet D1 enters between the platen P and the platen cover 21 at points Y–Z.

The sheet D1 is transferred rearwardly by the belt 13 until the front end of the sheet D1 passes a predetermined distance from the reference line X. The rearward transfer of the sheet D1 is controlled by rear end detection signal of the switch back sensor S3. Namely, the transfer belt 13 is rotated rearwardly until the pulse generating device 87 counts predetermined pulses (C pulse) after the rear end of the sheet D1 (front end of forward transfer) passes through the sensor S3. When the rear end of the sheet D1 reaches the point W, the belt 13 is stopped.

The sensor S3 is positioned near the downstream side of the platen P such that when the belt 13 transfers the sheet D1, the sensor S3 detects the sheet D1 until the pulse generating device 87 counts the predetermined pulses (B pulse) after the rear end of the sheet D1 in the forward movement passes through the sensor S2.

When the sheet D1 is transferred rearwardly by the belt 13, the platen cover 21 is moved upwardly from the platen P. Thus, the sheet D1 can easily enter into a space between the cover 21 and the platen P.

Figure 6A:
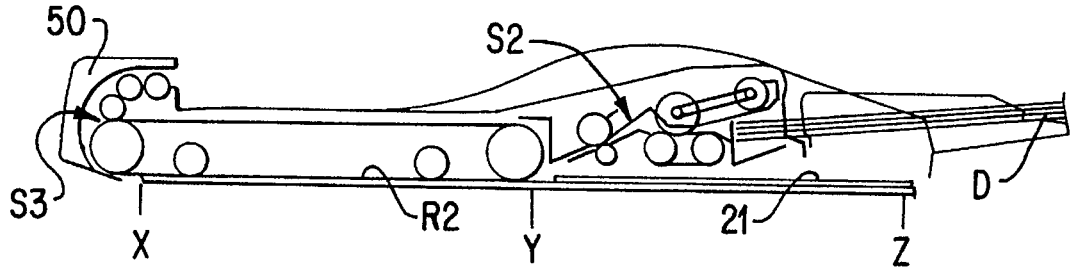
FIGS. 6(A) to 6(H) are explanatory side views for showing a transfer procedure of a large size sheet.
Figure 6B:
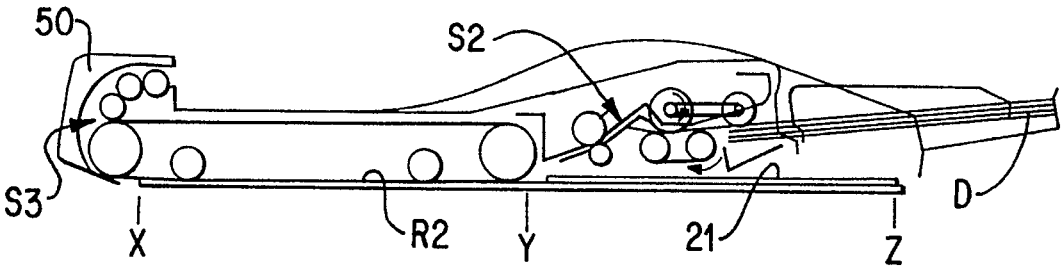
Figure 6C:
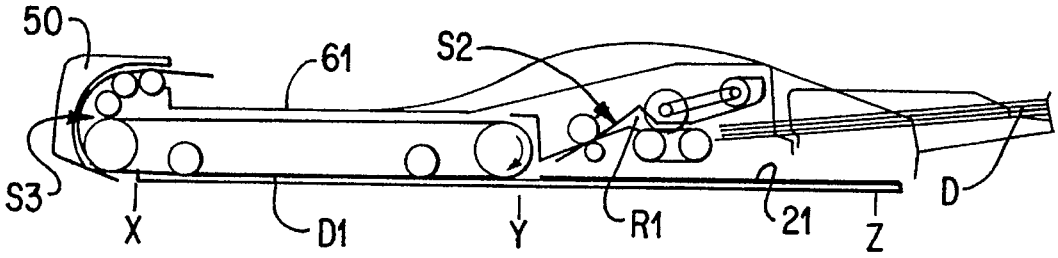
Figure 6D:
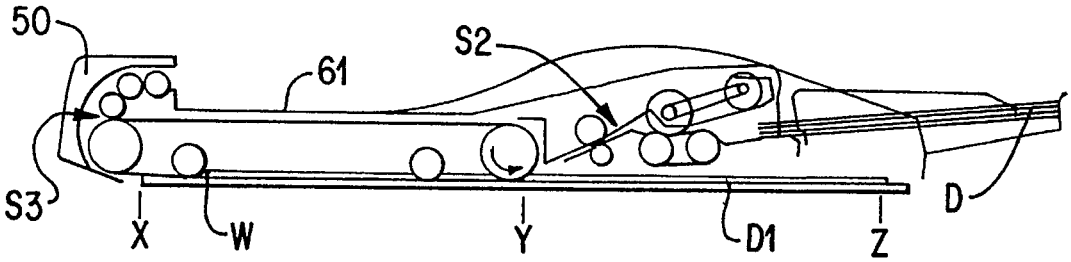
Figure 6E:
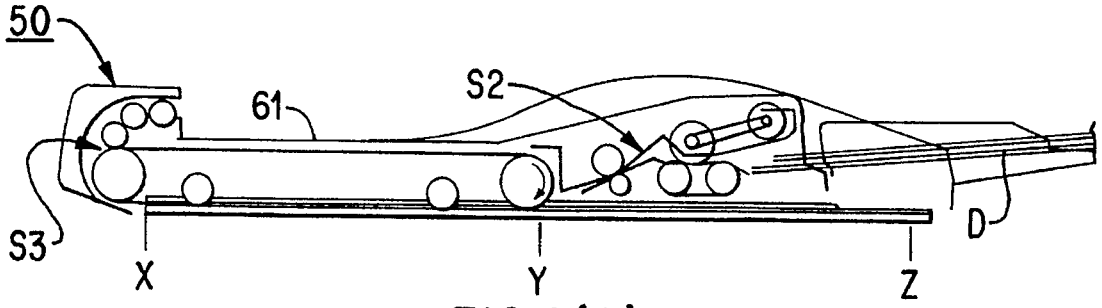

Thereafter, the transfer belt 13 is moved in the forward direction again, and when the front end of the sheet D1 in the forward direction reaches the reference line X, the transfer belt 13 is stopped (FIG. 6(E)). Namely, the number of overrun pulse (D pulse) from the reference line X at the time of reverse movement of the sheet D1 is counted in the reverse movement, and in the forward movement, the belt 13 is moved for the overrun pulse.

When the transfer belt 13 moves in the forward direction for the D pulse, the platen cover 21 is moved toward the platen P. As a result, the sheet D1 located under the cover 21 is pushed onto the plate P. Then, the copy is made. In case the empty sensor S1 does not detect the sheet on the tray 31, the transfer belt 13 and the ejecting belt 51 are rotated in the forward directions, so that the sheet D1 is transferred onto the tray 61 through the path R3.

Figure 6F:
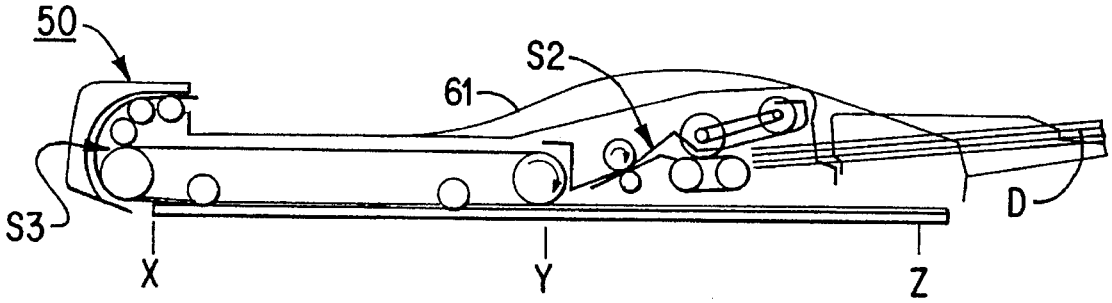
Figure 6G:
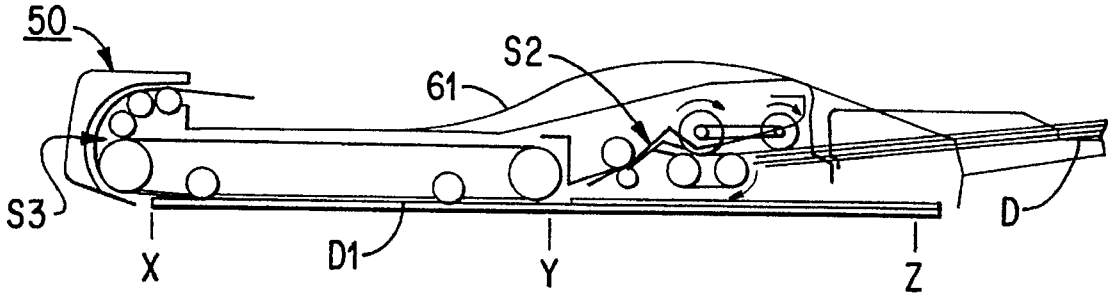
Figure 6H:
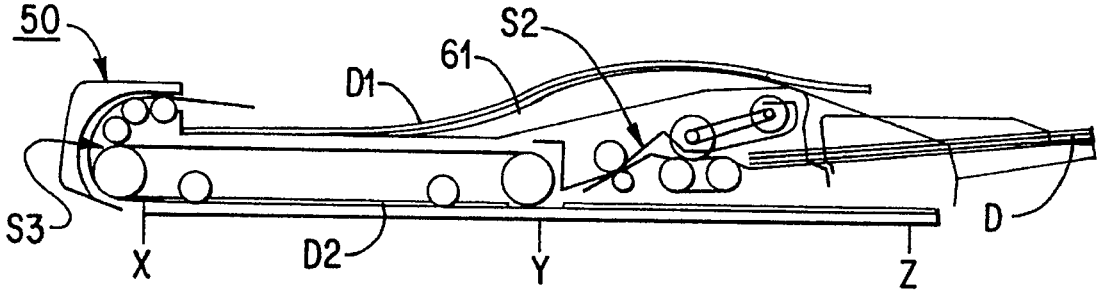

In case the empty sensor S1 detects the sheet D2 on the tray 31 as shown in FIG. 6(F), the motor M2 is actuated for the predetermined pulses (E pulse) according to the sheet size, and the rear end of the sheet D1 in the forward direction is transferred until the middle of the platen P (point Y). Then, the second sheet D2 is transferred to the register roller 451 (FIG. 6 (G)).

At this point, the motor M2 is rotated to simultaneously rotate the register roller 451, transfer belt 13 and ejecting belt 51. As a result, the first sheet D1 is transferred to the tray 61, and the next sheet D2 is moved to the point Y on the platen P. Then, the sheet D2 is transferred until the rear end of the sheet D2 reaches the point Y (FIG. 6(H)).

In the above embodiment, it is possible to make a large size copy by utilizing a small size transfer system. Thus, the entire system can be simplified to reduce manufacturing cost with light weight.

Figure 7:
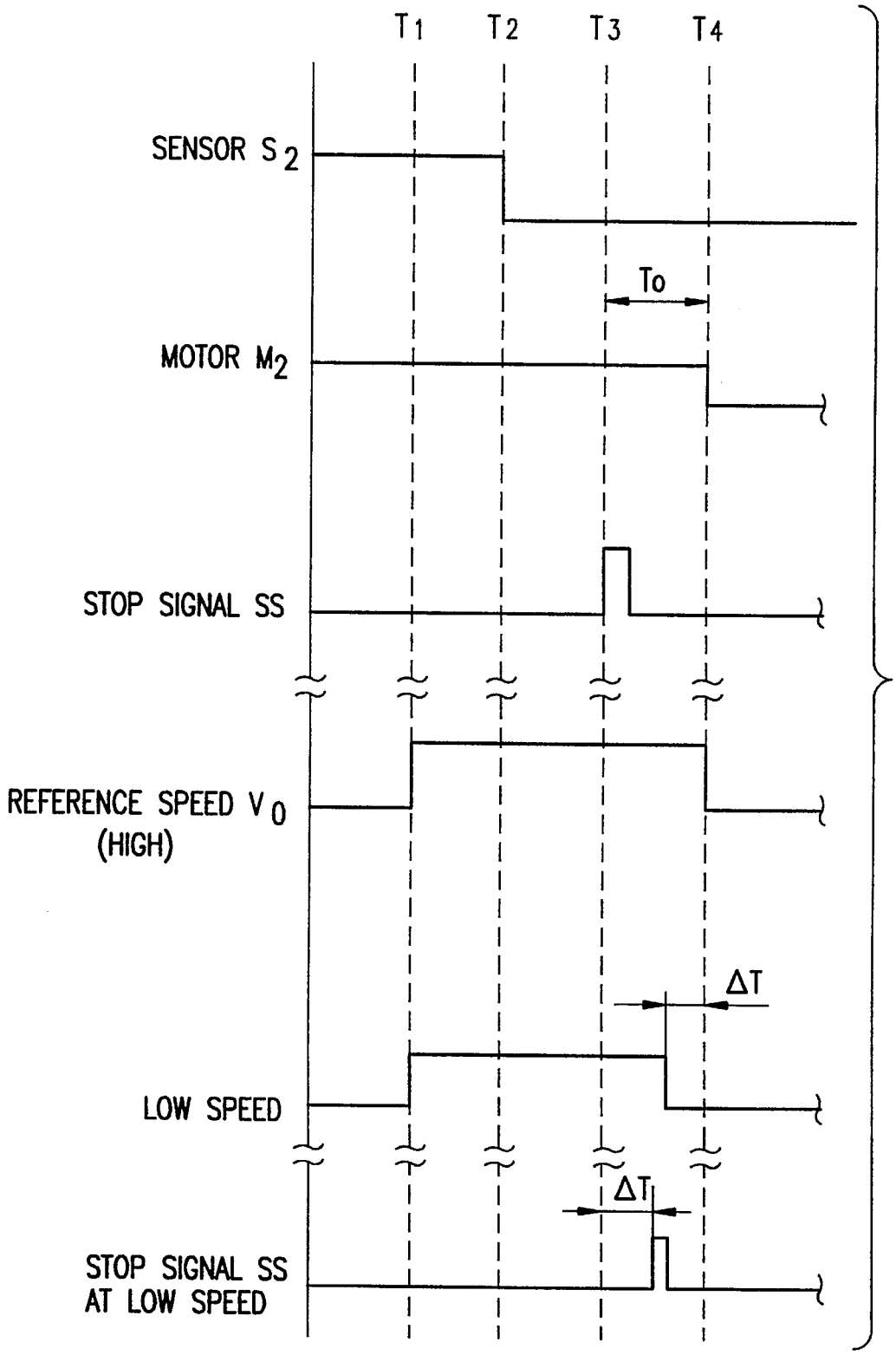
FIG. 7 is an explanatory chart of a second embodiment of the invention.

FIG. 7 shows a second embodiment for adjusting the movement of the sheet D. Mechanically, the second embodiment is exactly the same as the first embodiment. As shown in FIG. 7, in the second embodiment, the motor M2 starts to rotates at T1, and the rear end of the sheet D is detected by the sensor S2 at T2. A stop signal from the controlling device 80 is outputted to the motor M2 at T3, and the motor M2 actually stops at T4.

Assuming that the motor M2 is rotated at high speed, 209 pulses are counted (T3) after the sensor S2 detects the rear end of the sheet. If the stop signal for the motor M2 is outputted at T3, i.e. 209 pulses later from T2, the motor M2 rotates by inertia for an amount equal to 20 pulses.

In case a new sheet is set on the platen P while a sheet copied already is ejecting to the ejecting section, the motor M2 is rotated at a lower speed. Thus, if the stop signal is outputted to the motor M2 after 209 pulses are counted from T2, the sheet D stops before the reference line X for the distance of delta T corresponding to 6 pulses for the motor M2. Thus, in order to compensate the stop position, after the motor T2 is rotated further from T3 for an amount corresponding to 14 pulses, the stop signal SS is outputted, so that the motor M2 stops after overrun for an amount corresponding to 6 pulses.

Figure 8:
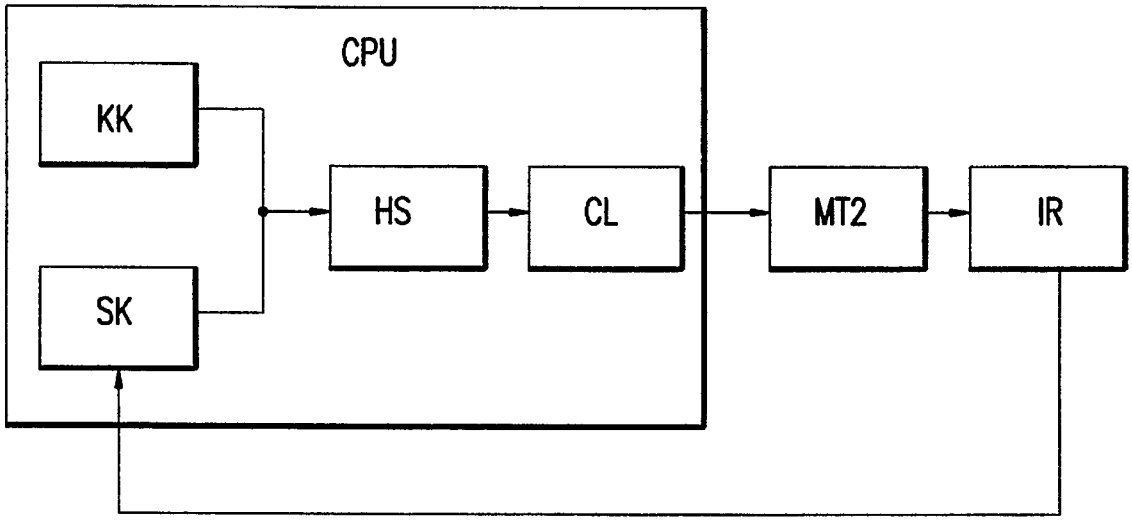
FIG. 8 is a block diagram for showing a controlling device of the second embodiment.

Thus, if the amount of the pulses for the motor M2 corresponding to the overrun amount or distance of the motor M2 is memorized in CPU based on the rotation speed of the motor M2, it is possible to stop the sheet exactly at the reference line X, as shown in FIG. 4 in the first embodiment, In FIG. 8, one example of the CPU is shown, which includes a motor speed detecting device SK, an inertia rotation detecting device KK, a compensating device HS for outputting a stop signal and a pulse generating device CL for a motor. The motor speed detecting device SK detects the speed of the motor M2 just before the stop of the sheet based on voltage or ampere of the motor. The inertia rotation detecting device KK together with the compensating device HS sets the output time of the stop signal by the overrun amount of the motor M2 based on the detected speed. The compensating device HS controls the stop timing for the pulses of the pulse generating device CL, so that the sheet is stopped exactly at the reference line X.

Figure 9:
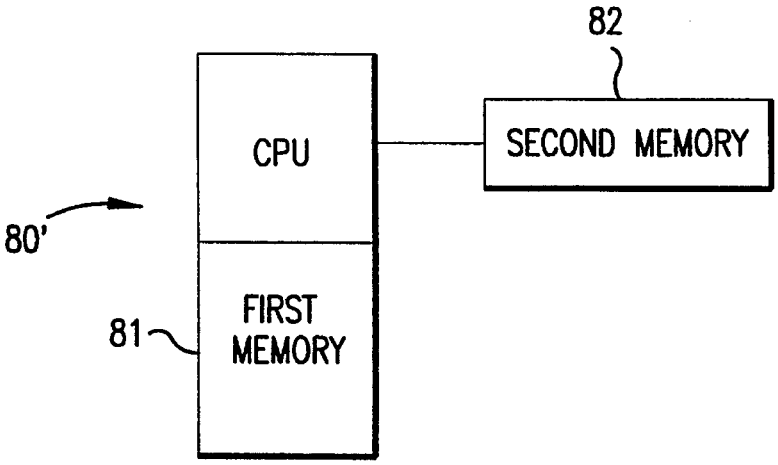
FIG. 9 is a block diagram for showing a controlling device of a third embodiment.

FIG. 9 shows a third embodiment for adjusting the movement of the sheet D, wherein the actuating and controlling section 80' as in FIG. 1 includes a first memory 81 and a second memory 82, such as EEPROM. The first memory 81 is contained in the section 80'. In the third embodiment, the mechanical structure is substantially the same as in the first embodiment. However, in the third embodiment, a sensor S6 for sensing a rear end of the sheet is installed (See FIG. 1).

In the third embodiment, when the paper size is sensed by the sensor S6, predetermined stop pulses $N_0$ corresponding to the size of the sheet are set, which are compensated for the slip between the belt and the sheet based on experiments. For example, A3 sheet is 128 pulses, and B5 sheet located laterally is 604 pulses. Then, it is confirmed if the actual stop data are memorized in the second memory 82. In case the stop data are memorized, compensated stop pulses Ns are set. The compensated stop pulses Ns are:

$$N_S = N_0 + \Sigma\Delta\mu_m \quad (1)$$

$$\mu_m = \Sigma\Delta N_{m-0+n} \quad (2)$$

wherein n is an integer of $0 \leqq n \leqq (n_0-1)$, m is a predetermined number of times greater than $n_0$, and $N_0$ is a sample number.

For example, m=15 and $N_0=5$, $\mu_m$ is an average value of Delta N at the time of operation Nos. 10, 11, 12, 13 and 14. Generally, the overrun pulse Delta N is a difference between N and $N_0$, i.e. $\Delta N=N-N_0$.

In case if there are no data in the second memory 82, compensated stop pulses Nt are:

$$Nt=N_0+\mu_n \quad (3)$$

$m_n$ is determined as:

$$\mu_n=\Sigma\Delta N_{n-1}/n-1 \quad (4)$$

wherein n>1, and first data are predetermined by experiments.

While the above calculation is made, the sheet is being transferred. When the timing sensor S6 detects the end of the sheet, the pulses Ns or Nt are started to count down. When the pulses Ns or Nt are counted down, the motor M2 for the belt 13 is stopped to locate the sheet at the reference line X.

After the sheet is located at the reference line X, the copy machine is actuated, and then, the sheet on the platen P is ejected, as usual.

In the above example, non-volatile second memory 82 is used to provide the data for the next use. However, the second memory 82 may be omitted. In this case, when the CPU is turned off, data in the CPU is deleted, so that in each time, data must be collected.

Figure 10:
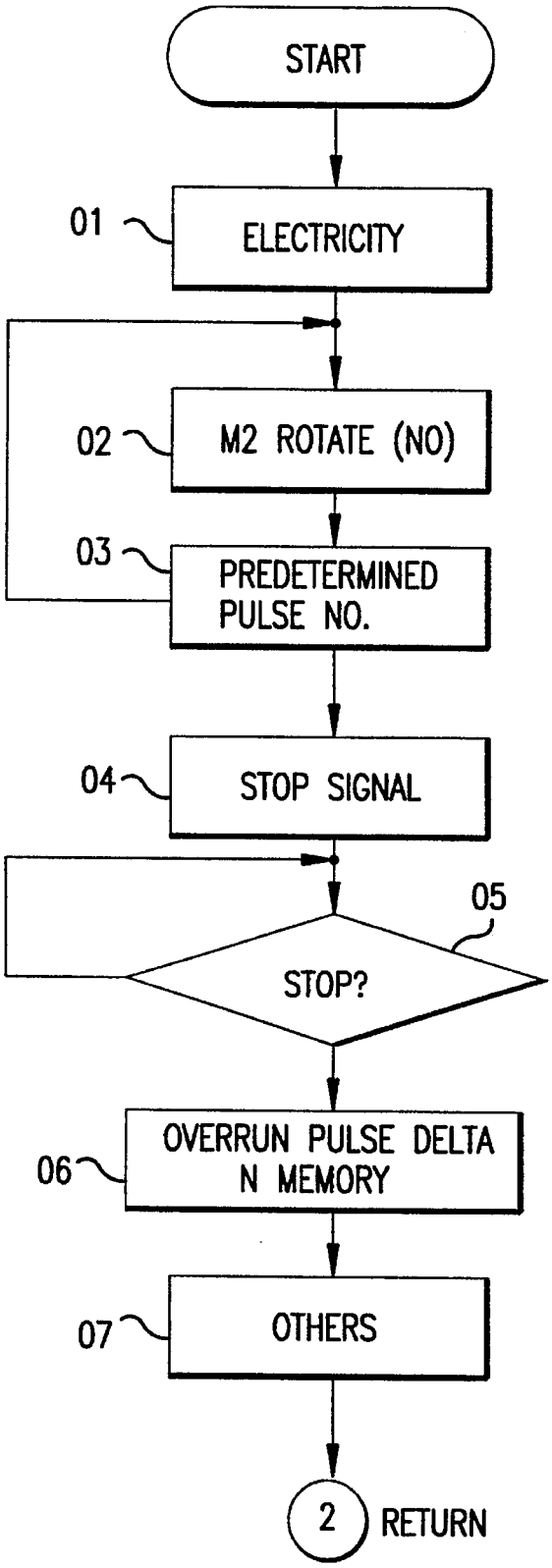
FIGS. 10 and 11 are flow charts for showing a fourth embodiment of the invention.

A fourth embodiment for adjusting or compensating the movement of the sheet D is explained. In the fourth embodiment, the basic operation mode for the feeder F is substantially the same as in the first embodiment. However, when electricity is initially supplied to the feeder, i.e. copy machine, the specific initial processing is made, which is shown in FIG. 10.

When electricity is supplied to the feeder (step 01), the motor M2 for the transfer section 10 rotates in the forward direction for a predetermined number of pulses $n_0$ (step 02). After the motor M2 rotates for the pulses $n_0$, a stop signal is outputted (steps 03 and 04). At this time, the motor M1 for the pick-up roller and so on is rotated to return the mechanism to the initial position.

The actual transfer distance, i.e. overrun pulses Delta N, until the belt 13 stops after the stop signal is outputted is detected by the pulse generating device 87 in FIG. 1, which is memorized in the actuating and controlling device 80 (steps 05 and 06). Also, other initial processing is made (step 07).

When the feeder F is used, the feeder F operates as in the first embodiment. After the paper size is determined by the sensor S2 in the separating and feeding section 40, the predetermined stop pulses $N_0$ is set. The stop pulses $N_0$ are the pulse numbers of the motor M2 that the front end of the sheet stops at the reference line X after the sensor S2 or a stop timing sensor, such as S6, detects the rear end of the sheet. For example, 128 pulses for A3 size paper.

After the stop pulses $N_0$ are set, the memorized overrun pulses Delta N are referred to, and the stop pulses $N_0$ are adjusted:

$$Ne=N_0-\Delta N$$

The prosecution pulses Ne are determined, and the motor M2 is actuated based on the prosecution pulses Ne, so that the sheet is transferred to the reference line X. For example, if the overrun pulses Delta N are 5 pulses and A3 paper is used ($N_0$ is 128 pulses), Ne=128−5=123. The motor M2 is stopped at the 123 pulses from the stop timing sensor.

After the sheet is stopped, the sheet is processed to make a copy, and then, the sheet is ejected, as explained in the first embodiment.

A modified example similar to that shown in FIG. 10 may be made, wherein when electricity is supplied, the initial processing is made. After a sheet is put on the tray for feeding into the feeder F, a dummy paper processing is made, which is shown in FIG. 11.

Namely, after the sheets to be copied are set on the tray, when a sheet feeding button is pushed (step 01), it is confirmed if there are compensating data, i.e. overrun pulses Delta N, in a memory (step 02). If there are compensating data, the dummy processing is completed, and normal processing, i.e. separating and feeding the sheet and transferring the sheet on the platen, continues.

If there are no compensating data, the motor M2 is rotated (step 03) and a stop signal is outputted after a predetermined number of pulses N1 (steps 04 and 05). The actual transfer distance, i.e. overrun pulses Delta N, until the belt 13 stops after the stop signal is outputted is detected by the pulse generating device 87 in FIG. 1, which is memorized in the actuating and controlling device 80 (steps 06 and 07).

Figure 11:
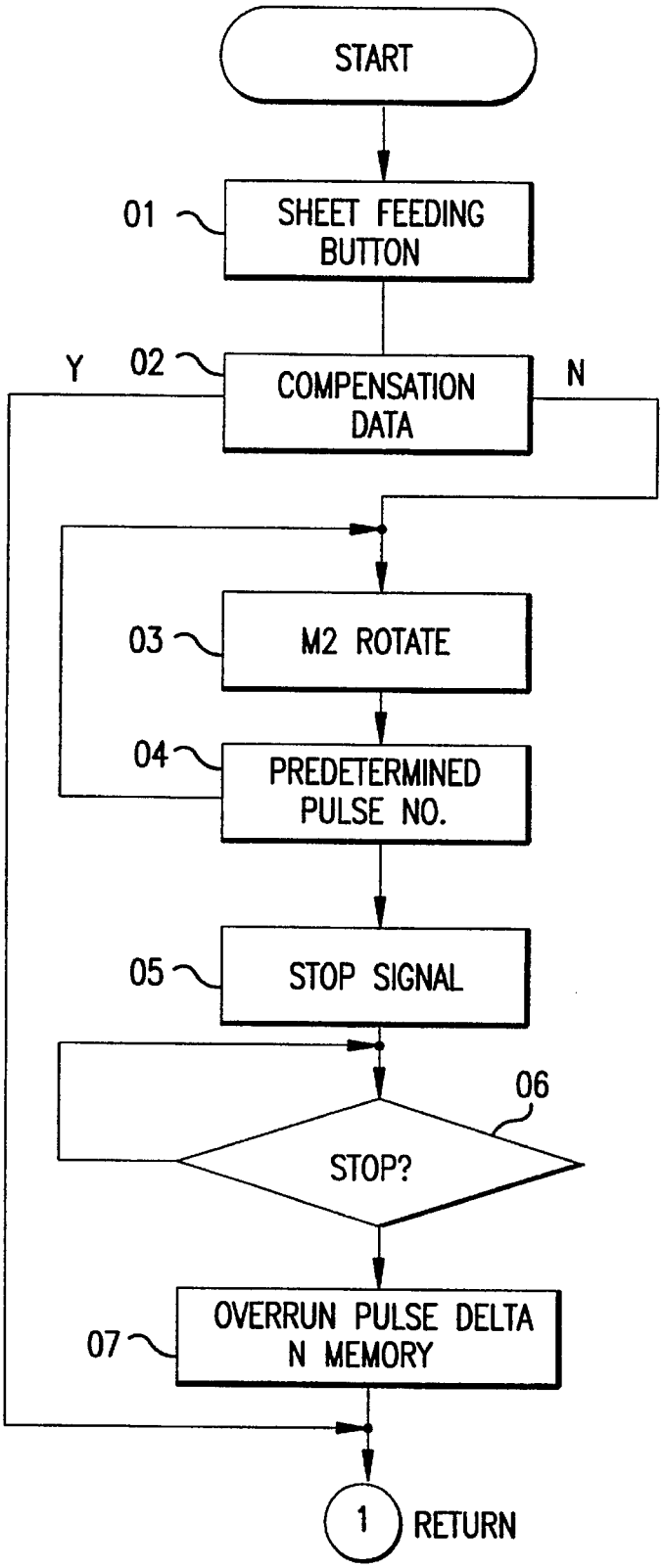

After the dummy process is made and the overrun pulses Delta N are memorized, the process as shown in FIG. 11 is returned to the regular feeding process, and prosecution pulses $Ne=N_0-\Delta N$ are calculated. Thereafter, the sheet is copied and processed further.

In the above fourth embodiment, the timing sensor S6 as in the third embodiment is located in the path R1 at a down stream side of the register roller 451 and the pinch roller 452, and the prosecution pulses Ne are started to be counted after the rear end of the sheet is detected by the timing sensor. Namely, the pulse from the timing sensor S6 enters into the counter of the pulse generating device 87, wherein when the pulse generating device is in a high condition, the counting is started from the end of the pulse, while when the pulse generating device is in a low condition, the counting is started from the beginning of the pulse. Thus, in the convention method, although the stopping position may not be stable for one pulse, the counting can be made correctly in this embodiment.

Further, in the above embodiment, the compensating data are obtained when a switch for the machine is turned on or a first copy is being made. However, it is possible to memorize the last feeding data used in the feeder F. Namely, the overrun amount of the last or latest sheet is memorized, and used for the overrun amount for the next feeding of the sheet.

Next, a fifth embodiment of the invention is explained, which is basically the same as in the first embodiment. However, the timing sensor S6 is located in the paper path R1 at a down stream side of the register roller 451 and the pinch roller 452.

Figure 12:
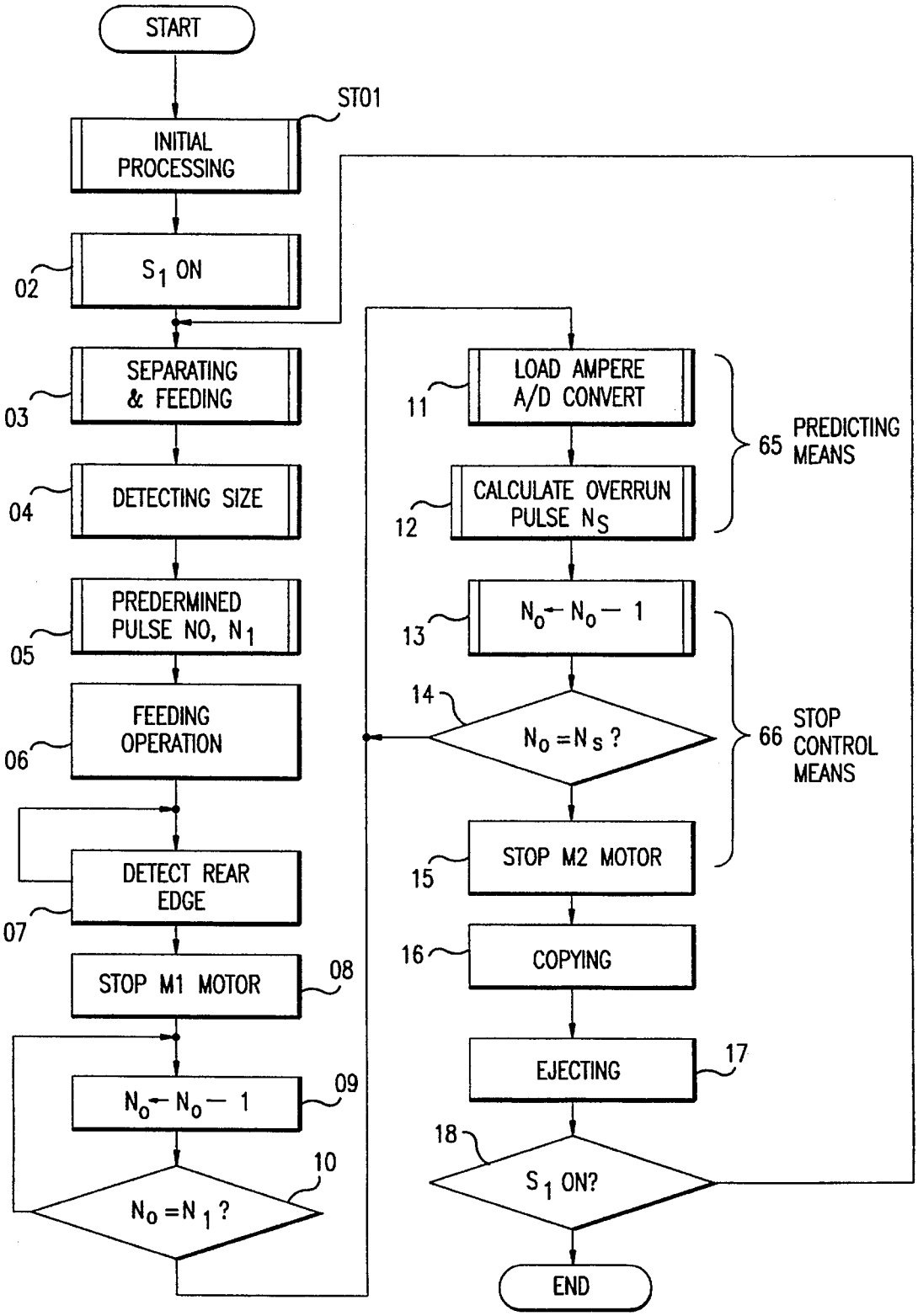
FIG. 12 is a flow chart for showing a fifth embodiment of the invention.

FIG. 12 shows a flow chart for the fifth embodiment. When the machine is turned on, the initial processing is made and the sheets on the tray is supplied to the separating and feeding section 40 (steps 01–03). When the sheet passes through the sensor S2, the size of the sheet is detected (step 04).

Then, a predetermined stop pulse value N0 and an intermediate pulse value N1 are selected based on the size of the sheet (Step 05). The predetermined stop pulse value N0 is a total pulse number until the front edge of the sheet stops at the reference line X after the rear edge of the sheet passes through the timing sensor S6. For example, A3 size sheet is 128 pulses and B5 sheet disposed laterally is 604 pulses. The intermediate pulse value is pulses for setting a timing to predict rotation amount, i.e. overrun pulse Ns, of the motor M2 after the motor M2 is turned off and a motor brake 64 (not shown) is turned on.

In case a predictable maximum overrun pulse number is Ns max, it is defined that N1>Ns max. Also, in case L1 is a predetermined distance, it is defined that Ns+L1=N0. This is because if the pulse value N1 is not within L1, it is not possible to complete calculation before the stop signal is outputted.

In this embodiment, after the sensor S2 detects the rear edge of the sheet, the sheet is further transferred for the distance corresponding to the pulse number N0, and then the sheet is stopped at the reference line X on the platen. Thus, when the rear edge of the sheet passes through the sensor 2, the sheet has already been transferred for a considerable distance toward the reference line X. Therefore, N1 must be within the distance L1.

The feeding operation continues (step 06), and when the rear edge of the sheet passes through the timing sensor S6 (steps 07 and 08), the above stop pulse N0 is started to count down. And the motor M2 stops (steps 09–12).

When the count down number comes to N0=N1, i.e. the timing to predict the overrun pulse Ns, frictional load is measured by a friction load detecting device 64 (step 11), and then the overrun pulses Ns are predicted based on the friction load (step 12). The steps 11 and 12 constitute predicting means 65 for predicting the overrun pulse numbers from the beginning of the stopping operation to the actual stop based on the amount of the detected friction load.

Figure 13:
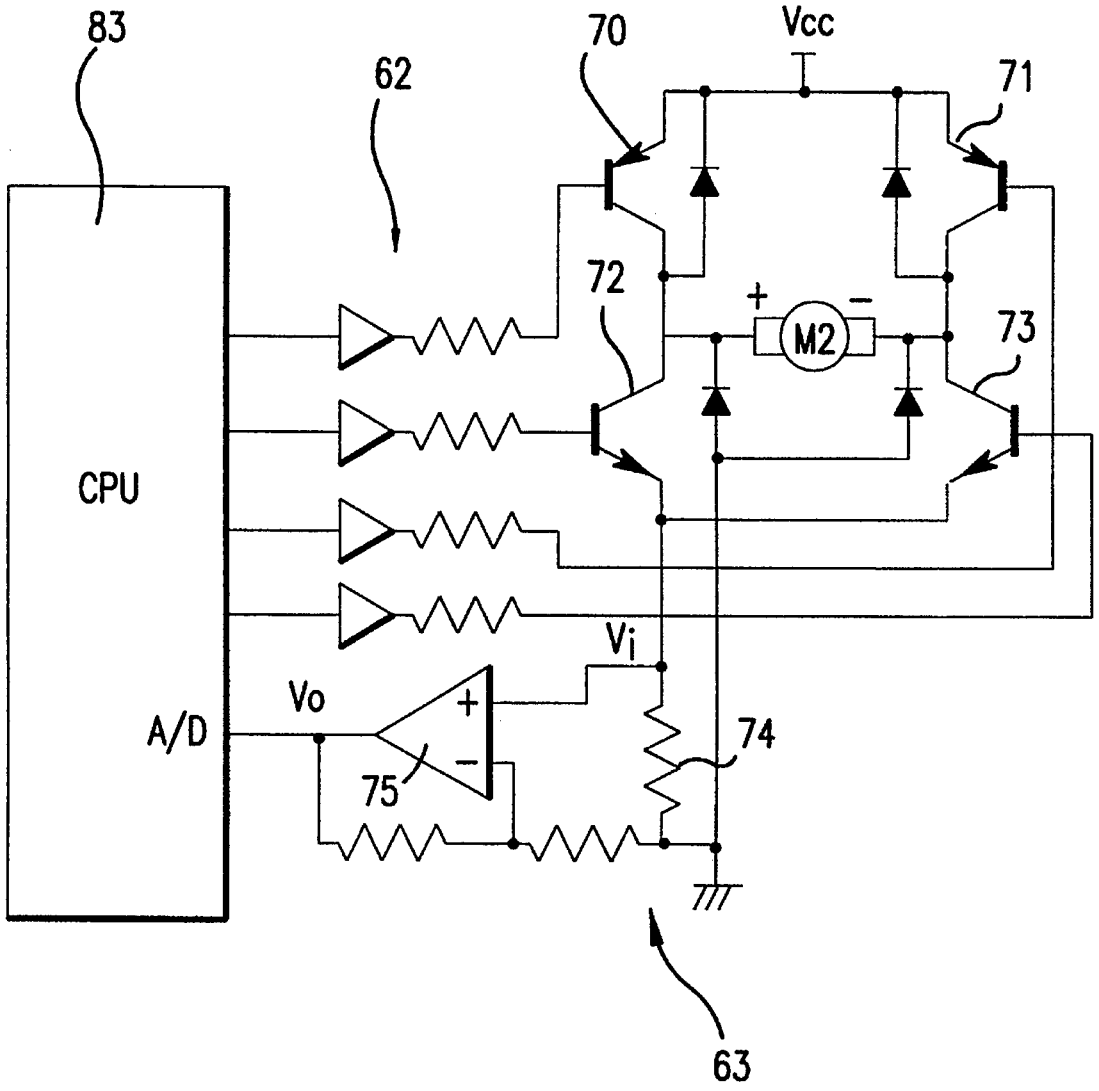
FIG. 13 is a circuit diagram for the fifth embodiment.

At this point, the detection of the load electricity or ampere of the motor M2 is explained with reference to FIG. 13, which shows a circuit 62 for the motor M2 and the friction detecting device 63, which are connected to a control device or CPU 83 (corresponds to the controlling section 80 in FIG. 1). Electricity is supplied to the motor M2 from the CPU 83 as signals through on and off operations of transistors 70–73. Namely, when the motor is rotated in the forward direction, the transistors 70, 73 are turned on, while the transistors 71, 72 are turned off, so that a plus terminal of the motor M2 is connected to plus electric potential, while a minus terminal thereof is connected to minus electric potential. On the other hand, when the transistors 71, 72 are turn on, and the transistors 70, 73 are turned off, the motor M2 operates in the reverse direction.

Electricity for the motor M2 flows to an electric source through a resistor 74, wherein electric potential Vi occurs due to electric drop at the resistor 74. Since the electric potential Vi is equal to a value of multiplication of load electric value of the motor M2 flowing through the register 74 and a known register value of the register 74, load electricity of the motor M2 can be detected by the electric potential Vi.

In the present example, a value of the electric potential Vi is amplified to a predetermined value by the calculation amplifier 75, and the value is inputted to an input terminal of an A/D converter. A/D conversion is made according to a program set by CPU, and analogue voltage applied to an A/D input terminal is changed to values to binary code which can be processed by the CPU. Thus, the data for load electricity of the motor M2 can be taken into the CPU.

In the document feeder, the main factor for changing stopping distance of the sheet transferred by the belt 13 is friction load. In the invention, the value of friction load is detected before the braking operation, i.e. when the count down value is N0=N1 (step 11), so that based on the detected value, it is possible to predict the overrun pulse Ns corresponding to the braking distance. In this respect, the motor M2 is a DC motor, wherein load torque applied to the motor is proportional to electricity passing through the motor, so that the amount of frictional load can be detected by the load electricity for the motor M2 detected as stated above.

In the present example, load electricity to be detected is divided in advance to sections, to which predicted overrun pulse numbers are assigned. The overrun pulse numbers are determined by experiments. In the CPU, when the load of the motor M2 is detected, it is studied to which section the detected value belongs, and the overrun pulse number Ns corresponding to the detected value is set as a predicted value (stet 12).

As explained above, the detection of the load electricity of the motor M2 and the assignment to the section of the predicted overrun pulse Ns are made quickly.

Then, when the counting down continues and comes the stop starting point, i.e. N0=Ns, electricity to the motor M2 is cut and brake is applied to the motor M2 (steps 13–15). The steps 13–15 constitute stop control means 66, which starts to stop the movement of the belt 13 while leaving the overrun pulse numbers from the predetermine pulse numbers.

As explained above, since the motor M2 is stopped at a point that the predicted overrun pulses are left, the sheet stops finally at the point N0=0. As a result, the sheet stops at the reference line X.

The sheet is then processed or copied, and the sheet is ejected (steps 16, 17). Incidentally, it is checked by the empty sensor S1 whether there is a sheet on the tray 31 (step 18). If there is a sheet on the tray, it is returned to the step 3 and the same procedure is repeated. If there is no sheet on the tray, the operation is completed.

In the above example, the overrun amount is predicted by measuring the friction load, which affects the overrun amount at the time of the sheet stopping, so that even if the overrun amount is changed by changing environmental condition, such as temperature and moisture, the size or quality of the sheet, or load change of the mechanical parts of the machine, it is possible to stop the sheet at the reference line by compensating the environmental condition.

In the above example, one side copy is explained, but it is possible to use for two side copies by using the ejecting sensor S3. Also, in the above example, the brake 64 is used, but the system is used for the feeder without the brake.

Further, in the above example, the stopping distance or overrun pulse Ns is predicted by detecting the friction load from the load electricity, and the predicted value is used for deciding the stop position for the sheet. However, it is possible to measure the actual stopping distance (overrun pulse Ns), and to use for the next use of the feeder the measured stopping distance as a compensating value. Namely, whenever the feeder is used, the pulse number (overrun pulse) after turning off the motor M2 is measured. In the next use, at the time of counting the pulse number obtained by deleting the overrun pulse numbers Ns from the total pulse number N0 required for stopping, the motor M2 is turned off or brake is applied. As a result, it is possible to adjust the change of the overrun pulse as time goes by or the change of the respective machines, and to increase accuracy of the stop. Also, the overrun pulse numbers may be obtained by average of several usages.

Next, a sixth embodiment of the present invention is explained, wherein movement of the rollers at the separating and feeding section 40 as shown in FIG. 1 is adjusted to properly feed the sheet to the register roller 451 and the pinch roller 452. Thus, the movement of the motor M1 is regulated by means of a CPU (not shown) in the actuating and controlling section 80. The operation of the entire system of the feeder F is the same as in the first embodiment as shown in FIG. 1.

In the first example in the sixth embodiment, when electricity of the machine is turned on, the initial processing is made, as usual. When a sheet or a document is placed on the tray 31, the empty sensor S1 operates, at which the feeder F receives a start signal from the copy machine M. Then, the motor M1 is actuated for a short period of time, and is stopped, at which overrun pulse number N2 from the beginning of the stop signal to the actual stop is memorized in the CPU.

The above procedure is repeated several time to obtain actual overrun pulse number N2, so that difference overrun pulse number Delta N relative to the predetermined overrun pulse number N1 is calculated:

$$\Delta N = N2 - N1$$

Average value mu for n times is obtained as:

$$\mu = \Sigma \Delta Nn/n$$

Further, renewed predetermined pulse number N0' explained later is calculated as:

$$N0' = N0 - \mu$$

And the result is memorized in a second memory.

During the above procedure, the sheets are separated by a separating plate, so that the sheets do not stick to each other.

Thereafter, the pick-up roller 42 starts to pick-up the first sheet from the tray 31, and separates the first sheet from others by the separating roller 43 and the belt 44. Then, the sheet is transferred in the down stream direction.

When the front edge of the sheet is detected by the register sensor S2, the pulse number of the motor M1 is counted, and when the pulse number counts up to the predetermined number N0, the stop signal is outputted. The pulse number N0 was already compensated, as explained above.

Although the motor M1 receives the stop signal, the motor M1 further rotates for the amount corresponding to the overrun pulses N2 determined by the condition at that time. Then, the motor M1 actually stops.

Then, the sheet is transferred by the compensated pulse number N0 and the actual overrun pulse number N2, so that the front edge of the sheet abuts against the register roller 451 and the pinch roller 452 and the rear edge of the sheet is further transferred. Therefore, the sheet is slightly curved in the path R1, and the front edge of the sheet enters equally into a portion between the register roller 451 and the pinch roller 452. Skew of the sheet due to pick-up and separation of the sheet is thus properly corrected.

Also, the sheet surely reaches the register roller 451 and the pinch roller 452, and is not over transferred, as well.

Figure 14:
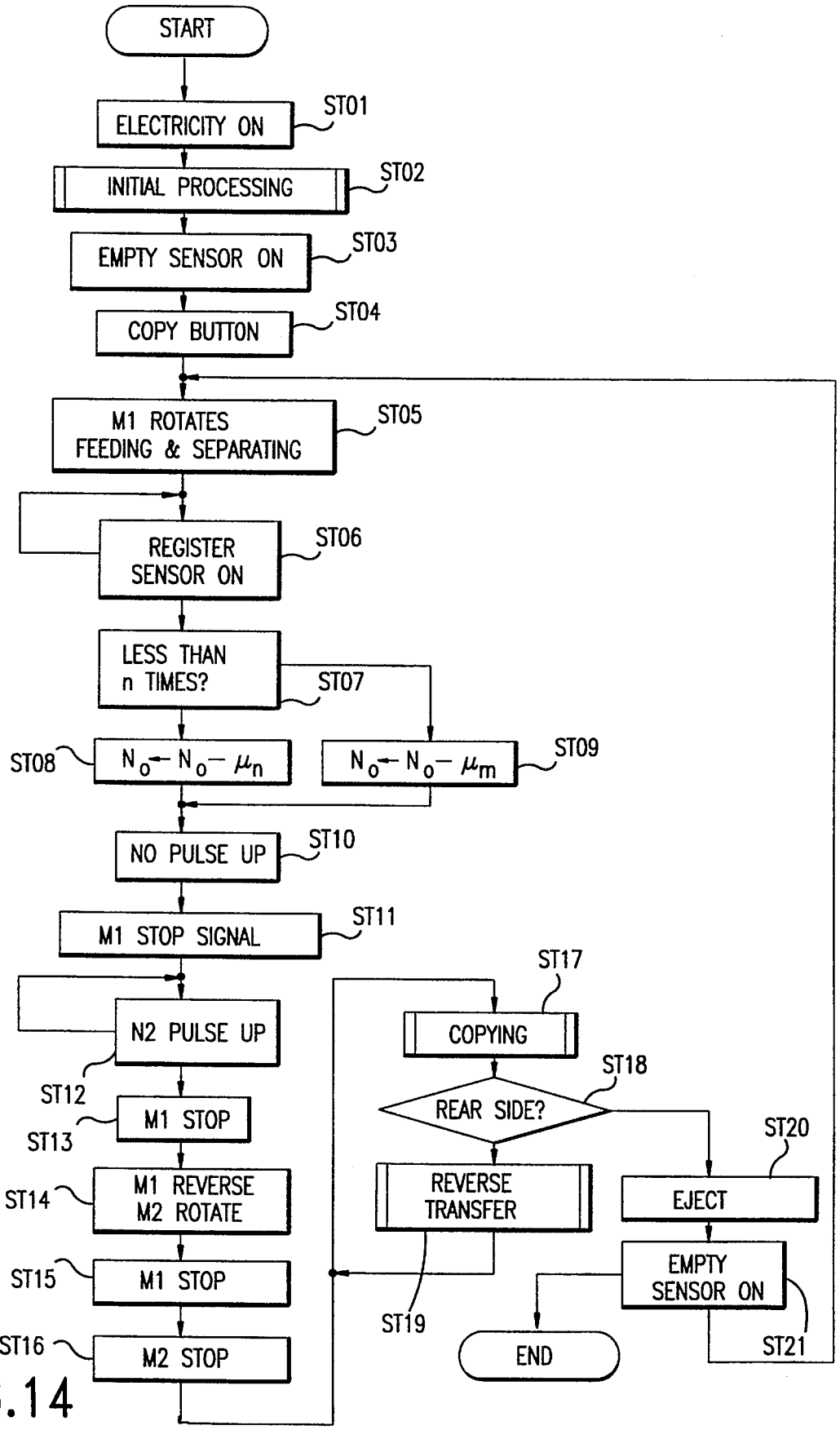
FIG. 14 is a flow chart of one example of a sixth embodiment of the invention.

Now, a modified example is explained with reference to FIG. 14. In this example, when a copy button is pushed after the initial processing is over (steps 1–4), the motor M1 is rotated in the forward direction and the pick-up roller 42 operates to feed the sheet. Then, when the register sensor S2 detects the front edge of the sheet (step 6), a stop signal is ejected, at which the number of the operation is checked (step 7). If the particular operation is less than n'th time (step 8), the predetermined pulse number N0 until the stop signal is outputted is compensated as:

$$N0' = N0 - \mu_n$$

$$\mu_n = \Sigma \Delta N_{n-1}/n-1$$

wherein n>1, and a pre-selected number is given for the first time. Delta N is the same as the first example.

When the operation is made more than n times (step 9), the predetermined pulse number N0 is compensated as:

$$N0' = N0 - \mu_m$$

$$\mu_m = \Sigma \Delta N_{m-n0+n}/n_0$$

wherein n is an integer and satisfies the equation of $0 \leqq n \leqq (n_0 - 1)$, and m means a desired number of times greater than $n_0$.

For example, in case m is the 10th time, and $n_0$ is 5, mu is an average of Delta N at 5th, 6th, 7th, 8th and 9th times.

When the predetermined pulse $N_0$, which is compensated as stated above, is counted out, the stop signal for the motor M1 is outputted (step 11), from which the motor M1 rotates or overruns for the amount of N2 pulses and then stops (steps 12 and 13). During the pulses $N_0$+N2, the front edge of the sheet abuts against the register roller 451 and the pinch roller 452, and further, the rear edge of the sheet is curved to properly correct skew of the sheet.

Thereafter, the rollers 451, 452 together with the belt 13 are rotated by the motors M1, M2, and the sheet is transferred onto the platen P (steps 14–19). Then, copy is made (step 17), and if a reverse side of the sheet is to be copied, the sheet is reversed at the ejecting section 50 (step 19). Then, copy is made again.

On the other hand, in case of one side copy, the sheet is ejected as it is (step 20). Also, it is checked by the empty sensor S1 if the sheet is left on the tray (step 21). If there is a sheet, the procedure is returned to the step 5, and if no sheet is found, the procedure is completed.

In the above examples, the predetermined time after the sheet is detected is the pulse number N0 obtained by the pulse generating device attached to the motor M1, but the predetermined time may be counted by a timer TO provided in the control device. Because, in case pulse number per time is p pulse/time, it may be expressed as:

$$p \times T0 = N0$$

it may be possible to change T0 after N0 is compensated by the above procedure.

In case the difference overrun pulse Delta N is expressed as time per pulse, t/pulse, and it is defined as:

$$t \times \Delta N = \Delta T$$

In case the Delta T is calculated based on the above equation, the above TO can be directly compensated.

In the present invention, the sheet transfer is properly made based on the amount of slip between the belt or roller and the sheet. Thus, the sheet can be transferred and stopped at a desired position.

As a sensor, light emitting and receiving elements may be used, wherein one of the light emitting and receiving elements may have a sensitivity control device to receive output power at a predetermined value, and a memory for memorizing the controlled output power. The light emitting and receiving elements are controlled by the value in the memory, so that the sensitivity of the sensor is improved.

While the invention has been explained with reference to the specific embodiments of the invention, the explanation is illustrative, and the invention is limited only by the appended claims.

What is claimed is:

1. An automatic document feeder for feeding manuscripts, comprising:

a motor having a pulse generating device proportional to a manuscript transfer operation, a feeding device operated by the motor and separating one manuscript from others, a manuscript detecting device for detecting an edge of the manuscript, said detecting device being located at a downstream side of the feeding device, register rollers situated at a downstream side of the detecting device, said register rollers setting a timing for transferring the manuscript, a controlling device electrically connected to the motor and the detecting device, said controlling device, while the motor is actuating, outputting a stop signal to the motor when a predetermined number of pulses $N_0$ has counted after the detecting device detects a front edge of the manuscript, said motor being stopped after reference overrun pulses $N_1$ so that a front edge of the manuscript abuts against the register rollers and a rear edge of the manuscript is further transferred to adjust a posture of the manuscript, and a compensating device connected to the controlling device, said compensating device detecting an overrun amount of the motor from a time that the motor receives the stop signal to a time that the motor is actually stopped, and compensating an output time for the stop signal of the motor based on the overrun amount.

2. An automatic document feeder according to claim 1, wherein said compensating device actuates in one transfer operation and includes a calculating device which calculates a number of overrun pulses $N_2$ from the time that the motor receives the stop signal to the time that the motor is actually stopped, and overrun pulse difference $\Delta N$ with respect to the reference overrun pulses $N_1$; and a memory for memorizing the overrun pulse difference $\Delta N$ calculated by the calculating device, said compensating device renewing the pulses $N_0$ based on the overrun pulse difference $\Delta N$ memorized in the memory.

3. An automatic document feeder according to claim 1, wherein said compensating device includes, a pre-separating device for regulating the front edges of the manuscripts and separating the manuscripts, said manuscripts being pre-separated at the time of feeding the manuscripts while rotation of the feeding device being stopped for a predetermined time;

a calculating device, while the manuscripts are being pre-separated, calculating the overrun pulses $N_2$ of the motor from the output of the stop signal to the actual stop and the overrun pulse difference $\Delta N$ between the overrun pulse $N_2$ and the reference overrun pulse $N_1$;

a first memory for memorizing a result of the calculating device; and a second memory, an average $\mu$ of the overrun pulse difference $\Delta N$ obtained by a predetermined number n of the rotations and stops of the motor and calculated by the calculating device being memorized in the second memory, said compensating device renewing the pulses $N_0$ based on the $\mu$ memorized in the second memory.

4. An automatic document feeder according to claim 1, wherein said compensating device actuates in one transfer operation and includes a first calculating device which calculates a number of overrun pulses $N_2$ from the time that the motor receives the stop signal to the time that the motor is actually stopped, and overrun pulse difference $\Delta N$ with respect to the reference overrun pulses $N_1$;

a first memory for memorizing the overrun pulse difference $\Delta N$ calculated by the first calculating device;

a second calculating device calculating a predetermined number of the overrun pulse difference $\Delta N$ memorized in the first memory by a following equation (1); and a second memory for memorizing a result $\mu$ of the second calculating device, said compensating device renewing the predetermined pulse number $N_0$ based on a content memorized in the second memory by a following equation (2);

(1) $\mu_n=\Sigma\Delta N_{n-1}/n-1$ wherein $n>1$, and first data are predetermined, $\mu_m=\Sigma\Delta N_{m-n0+n}/n_0$ wherein n is an integer of $0\leqq n\leqq(n_0-1)$, m is a predetermined number of times greater than $n_0$, $\mu_n$ is simple average until n times, and $\mu_m$ is an average of $n_0$ times just before m times, and m is greater than n, (2) $N_0=N_0-\mu$ wherein $N_0$, is new predetermined pulse number, and $\mu$ is one of $\mu_n$ and $\mu_m$.

* * * * *